United States Patent [19]

Huntley

[11] Patent Number: 4,661,127

[45] Date of Patent: Apr. 28, 1987

[54] SUBMERSIBLE LIQUID/GAS SEPARATOR APPARATUS

[75] Inventor: Allan R. Huntley, Northwood, United Kingdom

[73] Assignee: Stone & Webster Engineering Limited, Central Milton Keynes, Great Britain

[21] Appl. No.: 783,223

[22] PCT Filed: Jan. 29, 1985

[86] PCT No.: PCT/GB85/00043

§ 371 Date: Sep. 23, 1985

§ 102(e) Date: Sep. 23, 1985

[87] PCT Pub. No.: WO85/03544

PCT Pub. Date: Aug. 15, 1985

[30] Foreign Application Priority Data

Feb. 2, 1984 [GB] United Kingdom ..... 8402769
Oct. 9, 1984 [GB] United Kingdom ..... 8425512

[51] Int. Cl.[4] ..... B01D 19/00

[52] U.S. Cl. ..... 55/174; 55/182; 55/343; 55/356; 55/426; 166/267

[58] Field of Search ..... 55/171, 172, 174, 182, 55/219, 343, 344, 346, 356, 358, 421, 424, 426; 166/267

[56] References Cited

U.S. PATENT DOCUMENTS

| | | | |
|---|---|---|---|
| 1,559,115 | 10/1925 | Marker et al. | 55/174 |
| 2,193,209 | 3/1940 | Sandberg | 55/219 |
| 2,507,273 | 5/1950 | Schultz | 55/219 |
| 2,710,071 | 6/1955 | Kinser et al. | 55/174 X |
| 2,990,796 | 7/1961 | Cole et al. | 114/0.5 |
| 3,246,451 | 4/1966 | Glasgow | 55/174 X |
| 3,318,074 | 5/1967 | Keller, Sr. | 55/174 X |
| 4,073,734 | 2/1978 | Lowrie | 55/174 X |
| 4,187,089 | 2/1980 | Hodgson | 55/219 |

FOREIGN PATENT DOCUMENTS

| | | | |
|---|---|---|---|
| 994040 | 6/1965 | United Kingdom . | |
| 891113 | 12/1981 | U.S.S.R. | 55/421 |
| 969282 | 10/1982 | U.S.S.R. | 55/174 |
| 1005820 | 3/1983 | U.S.S.R. | 55/174 |
| 1068140 | 1/1984 | U.S.S.R. | 55/174 |
| 1095932 | 6/1984 | U.S.S.R. | 55/174 |

*Primary Examiner*—Robert Spitzer
*Attorney, Agent, or Firm*—Kenyon & Kenyon

[57] ABSTRACT

A liquid/gas separator apparatus capable of being taken to a required location and sunk into position adjacent a submerged gas pipeline for separating intermittent slugs of liquid from gas in the pipeline includes at least one hollow elongated separator pressure vessel (3) having at least one inlet (4, 4*a*), for receiving from the pipeline, liquid/gas to be separated, at least one gas outlet (6, 6*a*) for discharging separated gas to another pipeline, and a plurality of liquid outlets (7) for liquid separated from liquid/gas in the separator vessel. Several hollow elongated liquid accumulator pressure vessels (8) are substantially rigidly interconnected, in spaced side-by-side substantially co-planar relationship, either by lateral pipes (9) or by a collector pipe (23) extending substantially horizontally at a lower level than the bottoms of the accumulator vessels (8) and connected to each accumulator vessel (8) by upwardly extending connecting pipes (24). Each accumulator vessel (8) is substantially rigidly connected to the liquid outlets (7) of the overlying transversely substantially horizontally extending separator vessel or vessels (3), by upwardly extending drain pipes (10). The drain pipes (10) and the lateral pipes (9) or connecting and collector pipes (24, 23) structurally link, and provide fluid flow communication between, the vessels (3, 8) for liquid accumulation and liquid level equalization purposes.

20 Claims, 5 Drawing Figures

SUBMERSIBLE LIQUID/GAS SEPARATOR APPARATUS

This invention relates to a submersible liquid/gas separator apparatus capable of being taken to a required location and sunk into position adjacent a submerged gas pipeline for separating intermittent slugs of liquid from gas in the pipeline.

Natural gas taken from sub-sea wells at locations remote from land and at considerable under-sea depths conveniently is piped through submerged pipelines to a discharge/collection location on land. Increasingly natural gas so found and produced is wet natural gas, which is natural gas interspersed, under certain conditions in the pipeline, with liquid hydrocarbon mixture. Thus gas conveyed under pressure along the pipeline is interspersed at times with slugs of liquid, which liquid must be separated from the gas and collected for disposal at some stage prior to use of the natural gas.

Conventionally this separation and collection is done by slug catchers located on land. These conventional slug catchers are large and utilize long multiple parallel pipes connected together by manifolds. By virtue of their large size and flexible configuration they take up a large amount of space and require considerable support at many points, which makes them unsuitable for use anywhere other than on land.

If a large slug catcher is needed offshore where the sea has considerable depth, it is extremely expensive to provide such an installation on a fixed platform above the sea, for any slug catcher configuration. In order to avoid the extreme expense of locating a slug catcher on such a fixed platform offshore, it is desirable to provide a slug catching apparatus which is compact and rigid, thereby allowing it to be taken out to sea and sunk into position on the sea bed or on foundations on the sea bed, near the well head or pipeline.

According to the present invention there is provided a liquid/gas separator apparatus capable of being taken to a required location and sunk into position adjacent a submerged gas pipeline for separating intermittent slugs of liquid from gas in the pipeline, including at least one hollow elongated separator pressure vessel having at least one inlet for receiving, from a pipeline, liquid/gas to be separated, at least one gas outlet for discharging separated gas to another pipeline, and a plurality of liquid outlets for liquid separated from liquid/gas in the separator vessel, and including a plurality of hollow elongated liquid accumulator pressure vessels each substantially rigidly interconnected, in spaced side-by-side substantially co-planar relationship, either by lateral pipes or by a collector pipe extending substantially horizontally at a lower level than the bottoms of the accumulator vessels and connected to each accumulator vessel by upwardly extending connecting pipes, and each accumulator vessel being substantially rigidly connected to the liquid outlets of the overlying transversely substantially horizontally extending separator vessel, by upwardly extending drain pipes, the drain pipes and lateral or connecting and collector pipes structurally linking, and providing fluid flow communication between, the vessels, so that in operation liquid separating out in the separator vessel passes downwardly from the separator vessel through the liquid outlets and communicating drainpipes into the accumulator vessels and from one accumulator vessel to another through the lateral pipes for liquid level equilisation purposes, or between the accumulator vessels and the collector pipe via the connecting pipes for liquid level equalisation and/or collection purposes.

The use of the lateral or connecting and collector pipes and the drainpipes as structural members minimizes the external structural framework required in apparatus of the invention.

Advantageously the apparatus is floatable.

Preferably the separator and accumulator vessels are cylindrical in shape and advantageously the accumulator vessels are arranged parallel to one another. Conveniently the accumulator vessels are arranged so that in operation their longitudinal axes incline slightly downwardly towards one end in the direction of liquid outlet means located at or adjacent said one end. Preferably the liquid outlet means are outlet pipes opening one from each said one end of the accumulator vessels. Alternatively the liquid outlet means are outlet apertures one in each of the accumulator vessels through the bottoms thereof, in liquid flow communication with uppermost ends of the respective connecting pipes.

Advantageously each drainpipe contains a smaller diameter longer length inner pipe preferably coaxially located therein and projecting at each end into the respective vessel so that an annular flow passage is defined between the outer surface of the inner pipe and the inner surface of the drainpipe for the passage of liquid from the separator vessel into the respective accumulator vessel and an inner flow passage is provided by the interior of the inner pipe for displaced gas to pass upwardly from the accumulator vessel into the separator vessel. Conveniently the upper end of the inner pipe is supported in the separator vessel by substantially vertically located plates which act as baffles or vortex breakers to reduce downward entrainment of gas in the liquid. Preferably the lower end of the inner pipe is flared or flanged to minimize entrainment of liquid in the displaced gas rising through the inner pipe from the accumulator vessel.

Advantageously the drainpipes and lateral pipes are short in length to locate the vessels close to one another for great rigidity. Conveniently the apparatus includs a frame on which the vessels are located, which frame is provided with means for location of the apparatus on the sea bed. Preferably the apparatus includes ballast means operable to enable the apparatus to be sunk to the required sub-sea location, which ballast means may be provided in the frame.

Conveniently the separator vessel inlet and outlets open through the side wall thereof with the liquid outlets being located at the bottom surface of the separator vessel, the gas outlet being located at the upper surface of the separator vessel and the liquid/gas inlet being located at a position on the surface of the separator vessel intermediate the liquid outlets and gas outlet.

Alternatively the apparatus includes two separator pressure vessels in spaced side-by-side coplanar relationship, with each separator vessel being connected to each accumulator vessel via respective drain pipes. Conveniently a liquid/gas inlet is located at one end of each separator vessel and a gas outlet at or adjacent the other end of each separator vessel.

For a better understanding of the present invention, and to show how the same may be carried into effect, reference will now be made, by way of example, to the accompanying drawings, in which.

Figure 1:
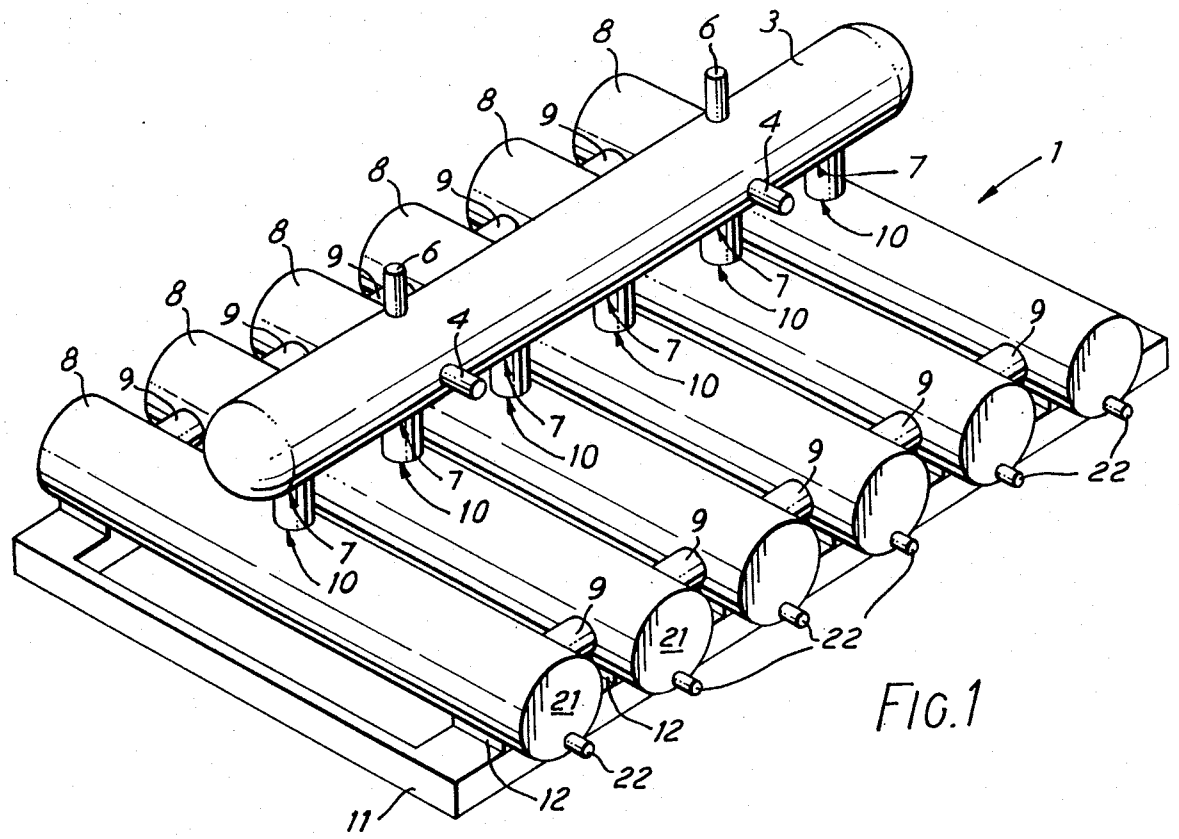
FIG. 1 is a diagrammatic perspective view of a liquid/gas separator apparatus according to one embodiment of the present invention.

As shown in the accompanying drawings a liquid/gas separator apparatus, generally referenced 1 is capable of being taken to a required location and lowered into position adjacent a submerged gas pipeline (not shown) on a sea bed 2 for operation to separate intermittent slugs of liquid, such as a liquid hydrocarbon mixture, from natural gas in the pipeline. Alternatively the apparatus may be capable of being floated to the required location. Although not described the apparatus may be used for separating gas from oil. The apparatus of the embodiment of FIGS. 1 to 3 includes at least one hollow elongated separator pressure vessel 3, which preferably is cylindrical in shape. This separator vessel 3 has at least one inlet 4, in this case two such inlets 4, for receiving from a pipeline, liquid/gas to be separated. As shown in FIGS. 2 and 3 the or each liquid/gas inlet 4 projects through the side surface of the separator vessel 3 and is substantially T-shaped in plan with its two outlet openings 5 opening substantially coaxially with the longitudinal axis of the separator vessel 3.

The separator vessel 3 also has at least one gas outlet 6, in this case two such gas outlets 6, for discharging separated gas to another pipeline. The or each gas outlet 6 opens through the upper side surface of the separator vessel 3. A plurality of liquid outlets 7 for liquid separated from liquid/gas in the separator vessel 3 open from the bottom surface of the vessel 3 as illustrated. Thus the liquid/gas inlets 4 are located at a position on the surface of the separator vessel 3 intermediate the liquid outlet 7 and gas outlets 6.

Figure 2:
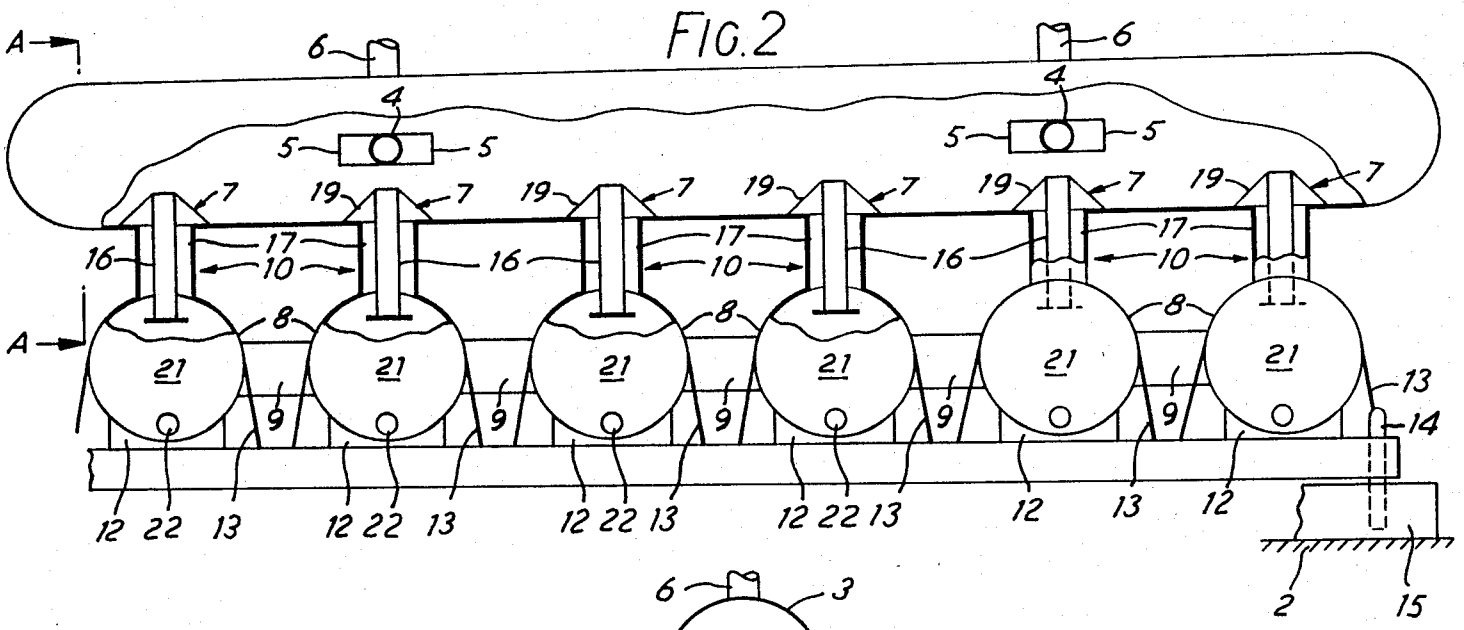
FIG. 2 is a part sectioned side view of the apparatus of FIG. 1 showing the apparatus in operative association with a sea bed.
Figure 3:
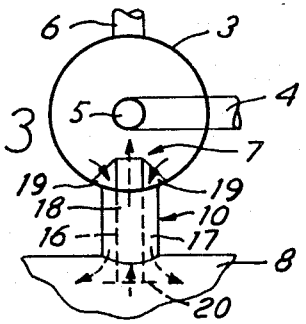
FIG. 3 is a sectional view taken on the line A—A in FIG. 2.

The apparatus of the embodiment of FIGS. 1 to 3 also includes a plurality of hollow elongated liquid accumulator pressure vessels 8 also preferably cylindrical in shape. These accumulator vessels 8 are each substantially rigidly interconnected, in spaced side-by-side substantially co-planar relationship, preferably in parallel with one another, by lateral pipes 9. Additionally the accumulator vessels 8 are each substantially rigidly connected, to the liquid outlets 7 of the overlying transversely substantially horizontally extending separator vessel 3, by upwardly extending drainpipes 10. The lateral pipes 9 and drainpipes 10 structurally link, and provide fluid flow communication between, the vessels 3 and 8 so that in operation liquid separating out in the separator vessel 3, under gravity or on expansion of the gas into the interior of the separator vessel 3, passes downwardly from the vessel 3 through the liquid outlets 7 and communicating drainpipes 10 into the accumulator vessels 8 and from one accumulator vessel 8 to another through the lateral pipes 9 for liquid level equalisation purposes. The use of short length relatively large diameter lateral pipes 9 and drainpipes 10 as structural members minimizes the external structural framework required and greatly enhances the rigidity of the resulting structure.

When the apparatus is required to be floatable the buoyancy may be enhanced by the use of relatively large volume vessels 3 and 8 making the apparatus floatable for towing on the sea surface to the location required. Alternatively floatation tanks may be provided on or attached to the apparatus. The lateral pipes 9 and drain pipes 10 are short in length to locate the vessels 3 and 8 close to one another for greater rigidity which enhances the compact nature of the apparatus and the tow ability when the apparatus is floatable.

To enable the apparatus to be sunk and lowered to the sea bed adjacent a natural gas well head or adjacent a submerged natural gas pipeline the apparatus may include ballast means such as tanks which may if desired be flooded for the descent of the apparatus. Additionally the apparatus includes a frame 11 on which the vessels 3 and 8 are located. The accumulator vessels 8 may be attached to the frame 11 in any convenient manner such as by saddle supports 12 and retaining straps 13 as shown in FIG. 2. Additionally the frame 12 is provided with means, such as a location socket which may follow a guide wire for installation onto a location pin 14 with a locking device for holding down the apparatus to foundations 15 secured to the sea bed 2, for example by piles. Alternatively the apparatus may be grouted on to piles.

As shown more closely in FIG. 3 each drainpipe 10 contains a smaller diameter longer length inner pipe 16 coaxially located therein and projecting at each end into the respective vessel 3 and 8. In this way an outer annular flow passage 17 is defined between the outer surface of the inner pipe 16 and the inner surface of the drainpipe 10 for the passage of liquid from the separator vessel 3 into the respective accumulator vessel 8. Additionally the interior of the inner pipe 16 provides an inner flow passage 18 for displaced gas to pass upwardly from the accumulator vessel 8 into the separator vessel 3 for example when liquid flowing into the accumulator vessel 8 displaces gas contained therein.

As illustrated in FIGS. 2 and 3 the upper end of the inner pipe 16 is supported in the separator vessel 3 by substantially vertically located plates 19 which act as baffles or vortex breakers to reduce downward entrainment of the gas in the liquid. The lower end of the inner pipe 16 may be flared or flanged as at 20 to minimize entrainment of liquid in the displaced gas rising through the inner pipe 16 from the accumulator vessel 18.

The apparatus may be so located adjacent the pipeline, and/or the relationship of the separator vessel 3 and accumulator vessels 8 may be such, that the longitudinal axes of the accumulator vessels 8 incline slightly downwardly towards one end 21 to facilitate the movement of collected liquid towards the end 21. To discharge or empty the collected liquid from the accumulator vessels 8 the ends 21 thereof conveniently are provided with liquid outlet means 22. Alternatively the outlet means 22 can be located in the bottom of each vessel 8. Moreover these outlet means 22 may include a valve openable and closable in response to the level of the liquid in the accumulator vessels 8 to discharge the liquid therefrom in any convenient manner, such as to an appropriate pipeline.

If nescessary the frame 11 can be made hollow to provide ballast chambers which can be air filled to enhance the buoyancy of the apparatus during floating and water filled for ballast, and to resist external pressure, when the apparatus is sunk and lowered to the desired sea bed location.

Figure 4:
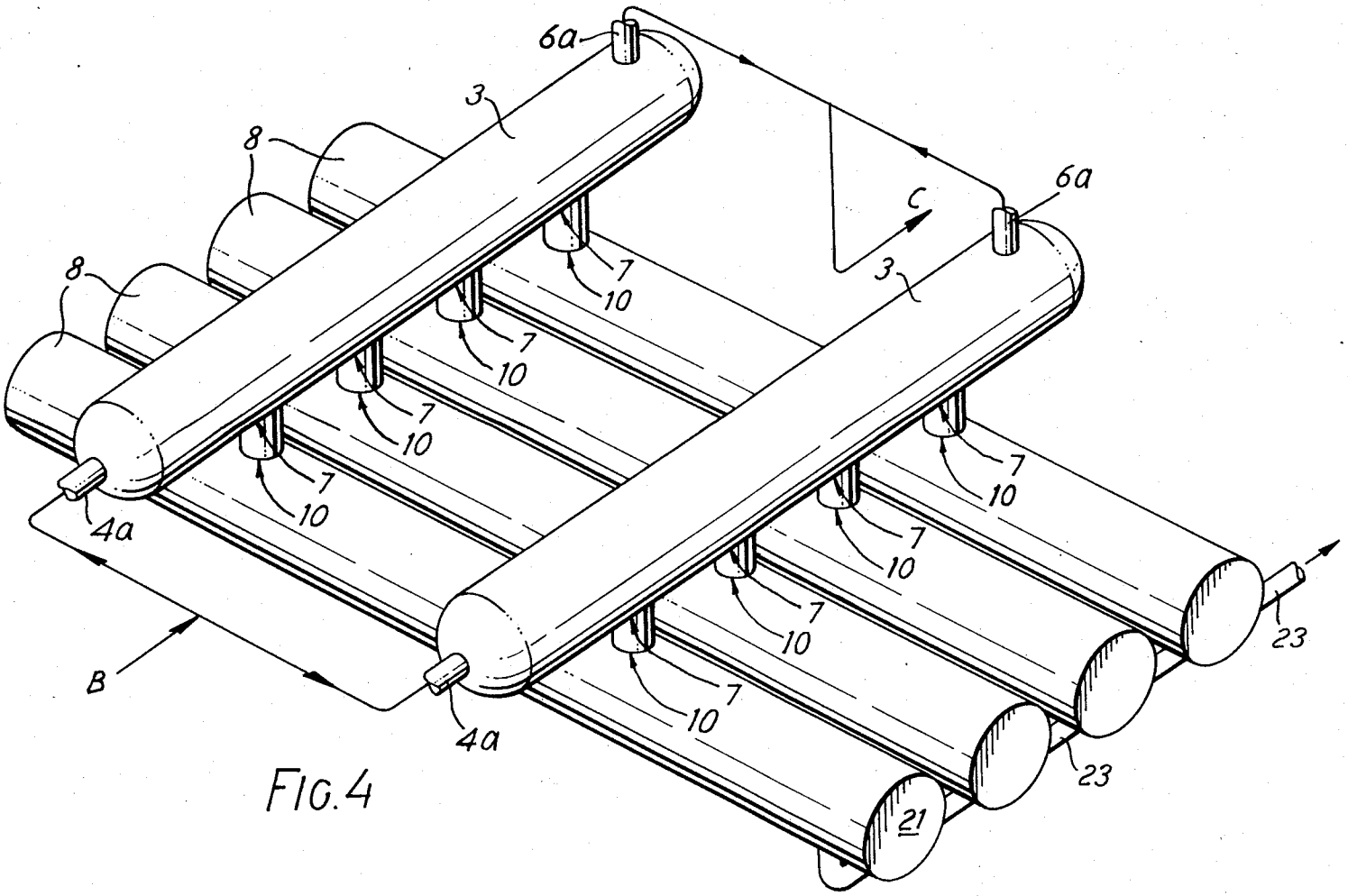
FIG. 4 is a diagrammatic perspective view of a liquid/gas separator apparatus according to a second embodiment of the invention.
Figure 5:
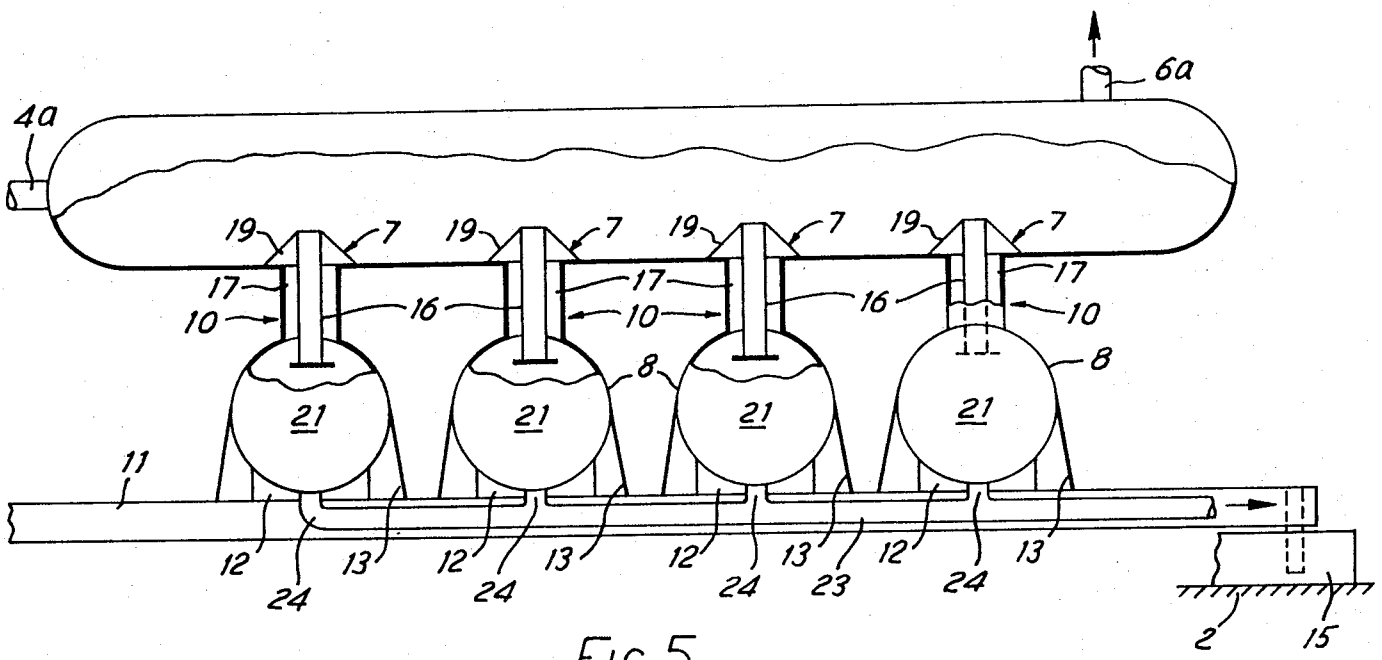
FIG. 5 is a part sectioned side view of the apparatus of FIG. 4, with addition of a frame, showing the apparatus in operative association with a sea bed.

The liquid/gas separator apparatus of the second embodiment as illustrated in FIGS. 4 and 5 basically is similar to that of FIGS. 1 to 3 and like parts bear like reference numerals and will not be further described in detail. However in the apparatus of FIGS. 4 and 5 the lateral pipes 9 are dispensed with and replaced by a collector pipe 23 which extends substantially horizontally at a lower level than the bottoms of the accumulator vessel 8, and a plurality of connecting pipes 24. These connecting pipes 24 extend upwardly and connect the pipe 23 to outlet apertures one in each accumulator vessel 8 through the bottom thereof as shown in FIG. 5, for liquid level equalisation between the vessels 8 and for collection purposes.

To this end the pipe 23 and the connecting pipes 24 may have larger diameters than otherwise for the single common outlet carrying the net liquid discharged from the vessels 8. Thus is apparatus of FIGS. 4 and 5, the liquid outlet means 22 in the lower ends of the vessels 8 are not required but the outlet apertures in the bottom of each vessel 8 are in liquid flow communication with uppermost ends of the respective connecting pipes 24.

Additionally the apparatus of FIGS. 4 and 5 has one or more, in this case, two separator pressure vessels 3 in spaced side-by-side coplanar relationship. Each accumulator vessel 8 is connected to each vessel 3 via respective drain pipes 10. In this embodiment each separator vessel 3 has a liquid/gas inlet 4*a* located at one end thereof for receiving liquid/gas mixture to be separated via a common supply line B. A gas outlet 6*a* is provided in each vessel 3 at or adjacent the end of the vessel 3 remote from the inlet 4*a*. Conveniently the outlets 6*a* are connected to provide a common outlet C for separated gas.

In use of the apparatus of the invention the net liquid from either embodiment may be displaced by gas provided that the liquid riser pipe from the pipe 23 is connected to a vessel on the surface, the flows from which are controlled to maintain a sufficiently low pressure in this vessel. When the liquid has thus been displaced from the vessels 8, a small flow of gas follows, limited by control instruments on the surface. No sub-sea liquid level controls or valves are necessary.

Although not shown in FIG. 4 for convenience the apparatus preferably includes a frame 11 as shown in FIG. 5.

I claim:

1. A liquid/gas separator capable of being taken to a required location and sunk into position adjacent a submerged gas pipeline for separating intermittent slugs of liquid from gas in the pipeline, including at least one hollow elongated separator pressure vessel having at least one inlet for receiving, from a pipeline, liquid/gas to be separated, at least one gas outlet for discharging separated gas to another pipeline, and a plurality of liquid outlets for liquid separated from liquid/gas in the separator vessel, and including a plurality of hollow elongated liquid accumulator pressure vessels each substantially rigidly interconnected, in spaced side-by-side substantially co-planar relationship, each accumulator vessel being substantially rigidly connected to the liquid outlets of the overlying transversely substantially horizontally extending separator vessel, by upwardly extending drain pipes, the drain pipes providing fluid flow communication between the separator vessel and the accumulator vessels, so that in operation liquid separating out in the separator vessel passes downwardly from the separator vessel through the liquid outlets and communicating drain pipes into the accumulator vessels, the drain pipes structurally linking the separator vessel to the accumulator vessels, further comprising coupling means for structurally linking the accumulator vessels to each other and for providing fluid flow communication among the accumulator vessels so that in operation liquid separated out in the separator vessel and accumulated in the accumulator vessels can pass from one accumulator vessel to another for liquid level equilisation purposes.

2. Apparatus according to claim 1, wherein the liquid/gas separator is floatable.

3. Apparatus according to claim 1 or claim 2, wherein the separator and accumulator vessels are cylindrical in shape.

4. Apparatus according to claim 1 or 2, wherein the accumulator vessels are arranged parallel to one another.

5. Apparatus according to claim 1 or 2, wherein the accumulator vessels are arranged so that in operation their longitudinal axes incline slightly downwardly towards one end in the direction of liquid outlet means located at or adjacent said one end.

6. Apparatus according to claim 5, wherein the liquid outlet means are outlet pipes opening one from each said one end of the accumulator vessels.

7. Apparatus according to claim 5, wherein the liquid outlet means are outlet apertures one in each of the accomulator vessels through the bottoms thereof, in liquid flow communication with uppermost ends of the respective connecting pipes.

8. Apparatus according to claim 1 or 2, wherein each drain pipe contains a smaller diameter longer length inner pipe preferably coaxially located therein and projecting at each end into the respective vessel so that an annular flow passage is defined between the outer surface of the inner pipe and the inner surface of the drain pipe for the passage of liquid from the separator vessel into the respective accumulator vessel and an inner flow passage is provided by the interior of the inner pipe for displaced gas to pass upwardly from the accumulator vessel into the separator vessel.

9. Apparatus according to claim 8, wherein the upper end of the inner pipe is supported in the separator vessel by substantially vertically located plates which act as baffles or vortex breakers to reduce downward entrainment of gas in the liquid.

10. Apparatus according to claim 8, wherein the lower end of the inner pipe is flared or flanged to minimize entrainment of liquid in the displaced gas rising through the inner pipe from the accumulator vessel.

11. Apparatus according to claim 1 or 2, wherein the drain pipes are short in length to locate the vessels close to one another for great rigidity.

12. Apparatus according to claim 1 or 2, which includes a frame on which the vessels are located, which frame is provided with means for location of the apparatus on the sea bed.

13. Apparatus according to claim 1 or 2, including ballast means operable to enable the apparatus to be sunk to the required sub-sea location.

14. Apparatus according to claim 13, wherein the ballast means is provided in the frame.

15. Apparatus according to claim 1 or 2, wherein the separator vessel inlet and outlets open through the side wall thereof with the liquid outlets being located at the bottom surface of the separator vessel, the gas outlet being located at the upper surface of the separator vessel and the liquid/gas inlet being located at a position on the surface of the separator vessel intermediate the liquid outlets and gas outlet.

16. Apparatus according to claim 1 or 2, including two separator pressure vessels in spaced side-by-side coplanar relationship, with each separator vessel being connected to each accumulator vessel via respective drain pipes.

17. Apparatus according to claim 16, wherein a liquid/gas inlet is located at one end of each separator vessel and a gas outlet at or adjacent the other end of each separator vessel.

18. Apparatus according to claim 1 or 2 wherein the coupling means includes lateral pipes extending between the accumulator vessels.

19. Apparatus according to claim 18 wherein the lateral pipes are short in length to locate the vessels close to one another for great rigidity.

20. Apparatus according to claim 1 or 2 wherein the coupling means includes a collector pipe extending substantially horizontally at a lower level than the bottoms of the accumulator vessels and connected to each accumulator vessel by at least one respective upwardly extending connecting pipe, so that in operation liquid separated out in the separator vessel and accumulated in the accumulator vessels can pass between the accumulator vessels and the collector pipe via the connecting pipes for liquid level equalization and collection purposes.

* * * * *